US006102351A

United States Patent [19]

Akrep

[11] Patent Number: 6,102,351

[45] Date of Patent: Aug. 15, 2000

[54] UNIFORM SECTION ROTARY SPREADER BEAM

[76] Inventor: Michael Akrep, Polar Focus, Inc., 217 Russell St., P.O. Box 3, Hadley, Mass. 01035-0003

[21] Appl. No.: 09/263,070

[22] Filed: Mar. 8, 1999

[51] Int. Cl.[7] ..... B66C 1/10; E04B 1/99

[52] U.S. Cl. ..... 248/324; 294/81.2; 294/81.3

[58] Field of Search ..... 294/81.1, 81.2, 294/81.21, 81.3, 81.4, 81.5, 81.56, 67.21, 67.5; 248/289.11, 317, 323, 324, 340

[56] References Cited

U.S. PATENT DOCUMENTS

| | | | |
|---|---|---|---|
| 2,703,252 | 3/1955 | Blackwell | 294/81.4 |
| 3,119,499 | 1/1964 | Tallquist | 294/81.4 |
| 3,549,190 | 12/1970 | Caldwell | 294/81.2 |
| 4,289,090 | 9/1981 | Bagby et al. | 294/81.56 |
| 4,355,832 | 10/1982 | Andersen | 294/81.3 |
| 4,685,714 | 8/1987 | Hoke | 294/81.2 |

FOREIGN PATENT DOCUMENTS

| | | | |
|---|---|---|---|
| 249 688 | 9/1987 | Germany | 294/81.2 |

*Primary Examiner*—Dean J. Kramer
*Attorney, Agent, or Firm*—Deborah A. Basile

[57] ABSTRACT

The invention is a set of two structural tubes joined by an axle with friction bearings. The axle allows the two tube sections to rotate in a plane with respect to each other, producing a relative angle (azimuth) between the two tubes. The axle is made of high strength steel and is threaded. Machined holes are in an evenly distributed pattern on the spines of the tubes. The utility of the invention derives from the uniform section shape of a square tube with a spine, where the spine has a pattern of through holes. The hole pattern is symmetric about the center hole in the pattern. When adjusting the relative angle a between the two structural tubes, four Vernier scales are exposed, two on each structural tube. The four Vernier scales may be viewed for use from the top-left, top-right, bottom-left or bottom-right approach to the device.

18 Claims, 4 Drawing Sheets

Side View

End View

UNIFORM SECTION ROTARY SPREADER BEAM

BACKGROUND OF THE INVENTION

Field of the Invention

This invention relates to the industry of suspending and focusing loads such as audio or video devices in a theater or concert hall.

Currently, in the industry there is one dominant method to suspend and focus audio and video devices. Most commercially available suspension systems are built specifically to suspend and focus one particular model of video or audio device. This results in an inventory of suspension kits and/or parts as numerous as the inventory of audio and video devices. The dominant methodology also does not incorporate into the suspension systems any method of measuring elevation and azimuth angles. The dominant approach for audio devices is to have kits which allow for crude adjustment of elevation angle, but require a custom frame to be manufactured to set an azimuth, with different frames required for different discrete azimuth settings. The dominant approach for video devices is a kit which allows a minute level of elevation adjustment, with a method of analog control over azimuth. The proposed invention provides analog control over azimuth with the built-in ability to read and set the azimuth of the suspended equipment. The friction bearings on the axle hold the azimuth setting, just as an automobile sun visor holds its position. This single device will work with a very broad range of audio and video devices, reducing the required inventory of suspension kits.

This invention is used where a load must be suspended and where the azimuth and elevation angles are both necessary elements of the correct suspension of the load. With the currently available devices, one has two options by which to do this:

1. Purchase a suspension system or kit that is built specifically to suspend one particular model of video or audio device with elevation control and design a custom frame to provide a fixed azimuth. Or,
2. Use standard suspension systems that will not allow for precise or accurate elevation and azimuth angle adjustment.

Maintaining an inventory of suspension kits to fit specifically with a particular model of video or audio device is expensive, impractical and inefficient. Furthermore, the kits are not specifically designed so as to measure angles; and therefore are not extremely adjustable and the load cannot be focused with precision or accuracy.

INVENTION DISCLOSURE STATEMENT

Currently there are two U.S. patents which teach spreader beams which may be used to suspend loads:

1. Tallquist U.S. Pat. No. 3,119,499
2. Caldwell U.S. Pat. No. 3,549,190

The present invention and Caldwell each have numerous load positions at discrete intervals. The present invention and Caldwell each rotates a load about a vertical axis. The present invention and Caldwell both must keep the load balanced. The present invention and Caldwell both intend to keep the load attachments on the spreader beam so that they cannot slip off. The present invention uses shackles and shackle pins to do so. Caldwell has a series of ridges which may allow slippage.

The present invention is significantly different from Caldwell as it has numerous load and support positions at discrete intervals and Caldwell has numerous load points but only one support point. Further, Caldwell uses custom-made rigging fittings. The UNIFORM SECTION ROTARY SPREADER BEAM uses only standard forged shackles. The UNIFORM SECTION ROTARY SPREADER BEAM uses Vernier scales for reading and setting the relative angle (azimuth) between the two structural tubes while Caldwell has no Vernier scale(s). Caldwell does not have an evenly spaced pattern of load points continuously along its length while the UNIFORM SECTION ROTARY SPREADER BEAM does. The friction bearings on the UNIFORM SECTION ROTARY SPREADER BEAM axle assembly will hold a set azimuth while Caldwell will not. The load attachments are capable of slippage on Caldwell but they cannot slip on the UNIFORM SECTION ROTARY SPREADER BEAM because shackles and shackle pins prevent slippage. The UNIFORM SECTION ROTARY SPREADER BEAM is for suspended static use while Caldwell is for dynamic dragging. The UNIFORM SECTION ROTARY SPREADER BEAM can be supported from a central attachment or a pair of attachments on either side of the central hole while Caldwell can only be supported from the central support. The UNIFORM SECTION ROTARY SPREADER BEAM has a symmetric cross section from top to bottom, while Caldwell does not. Caldwell has no geometry or feature to protect nameplates or adhesive labels showing ANSI B30.20 compliant declarations, instructions for use, safety warnings, or brand information while the UNIFORM SECTION ROTARY SPREADER BEAM has ridges specifically to protect labels and nameplates from abrasion.

Tallquist and the UNIFORM SECTION ROTARY SPREADER BEAM each rotate about a vertical axis. The UNIFORM SECTION ROTARY SPREADER BEAM and Tallquist can each suspend variable length loads. However, Tallquist is dissimilar from the present invention in that Tallquist is for use in logging while the UNIFORM SECTION ROTARY SPREADER BEAM is for use in audio, video and rigging. The UNIFORM SECTION ROTARY SPREADER BEAM has many load and support points while Tallquist has two load points and one rigid support point. Tallquist can only pick up loads which geometrically line-up with elements 66 and 67 in the Tallquist drawing. While Tallquist is suspended from a rigidly mounted axle, the UNIFORM SECTION ROTARY SPREADER BEAM is free hanging.

The UNIFORM SECTION ROTARY SPREADER BEAM is an unpowered device while Tallquist is a powered device with hydraulics. The UNIFORM SECTION ROTARY SPREADER BEAM load can be rotated about its axle by hand while Tallquist is strictly a powered device and cannot be operated manually. The UNIFORM SECTION ROTARY SPREADER BEAM has multiple discrete load points while Tallquist has a single axle for support and an analog range of load lengths which may be suspended. Tallquist is an overhead, multi-access gantry crane while the UNIFORM SECTION ROTARY SPREADER BEAM is a single axis device. The UNIFORM SECTION ROTARY SPREADER BEAM has a symmetric cross section (or uniform section) from top to bottom, while Tallquist does not. Tallquist has no geometry or feature to protect nameplates or adhesive labels showing ANSI B30.20 compliant declaration, instructions for use, safety warnings and brand information, while the UNIFORM SECTION ROTARY SPREADER BEAM has ridges specifically to protect labels and nameplates from abrasion. The UNIFORM SECTION ROTARY SPREADER BEAM uses Vernier scales for reading or setting the relative angle (azimuth) between the two structural tubes while Tallquist has no Vernier scale(s).

BRIEF SUMMARY OF THE INVENTION

It is an object of the present invention to provide the solution or the means to accomplish the goal; where a piece of audio or video equipment must be suspended at a particular elevation and azimuth without the need to purchase uniquely designed suspension rigging for the piece of equipment. The amphitheater, concert hall, or civic center would purchase only the present invention which would be used as the rigging device for any type of audio or video equipment which must be suspended.

A further object of the present invention is to incorporate Vernier scales to allow the relative angle (azimuth) to be read or set from four different approaches to the device. The invention is easy to adjust, it is lightweight, and it is inexpensive to manufacture.

A further object of the present invention is to use standard forged shackles for attachment points instead of more expensive custom fittings.

A further object of the present invention is to incorporate a plurality of attachment points to both the top and bottom to provide various possibilities for adjustment and/or attachment.

A further object of the present invention is to provide a suspension device which requires no tools or mechanisms to adjust azimuth.

A further object to the present invention is to provide a suspension device wherein the nameplates and adhesive labels on the device are protected from abrasion by ridges manufactured into the structural tube.

BRIEF DESCRIPTION OF THE DRAWINGS

For a better understanding of the present invention, and to show how it may be carried into effect, reference will now be made, by way of example only, to the accompanying drawings in which.

PREFERRED EMBODIMENT

Figure 1:
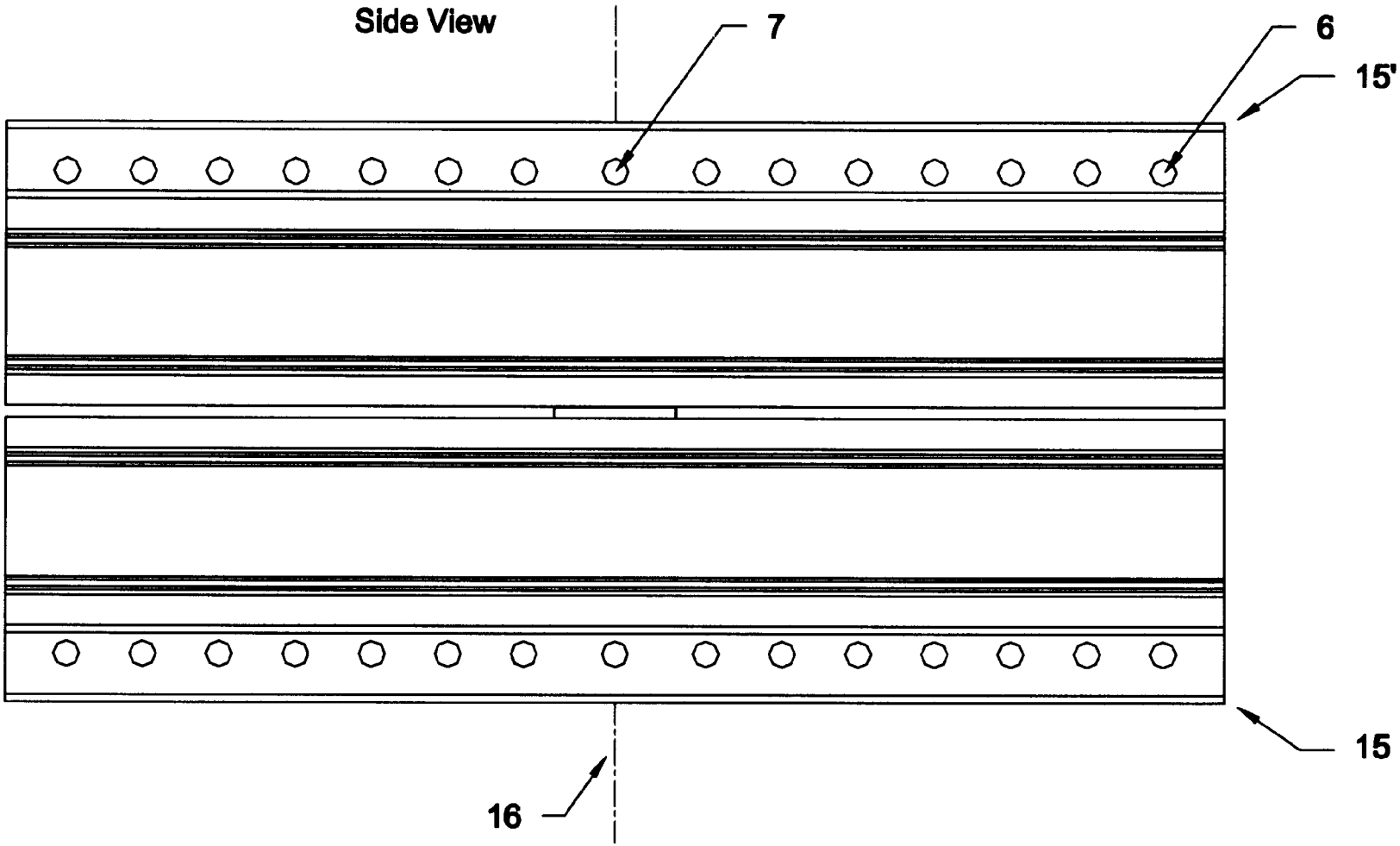
FIG. 1 is a side view of a suspension device in the form of a rotary spreader beam having two structural tubes in accordance with the invention.

The invention will be described in relation to a preferred embodiment for use in handling audio and video devices, it being understood that the embodiment shown can be used to handle other objects. Thus although specific forms, materials, and dimensions of the parts are referred to, these are not limiting features.

Referring now to FIGS. 1, 2, 3, and 4 is the suspension device in the form of a uniform section rotary spreader beam in accordance with the invention. The rotary spreader beam has a center vertical axis 16. The device includes two structural tubes: a bottom structural tube 1 (referred to in the claims as Tube A) and a top structural tube 1' (referred to in the claims as Tube B). Both tubes are preferably fabricated of a high strength steel.

The bottom structural tube 1 is preferably a rectangular-shaped elongate hollow tube having rounded edges. The bottom structural tube 1 has a top surface 17, bottom surface 18, front surface 19 and back surface 20, each rectangular in shape. The top surface 17 and bottom surface 18 are identical in shape and dimensions, while the front surface 19 and back surface 20 are identical in shape and dimensions. The bottom structural tube 1 may have either a square or a rectangular cross-section. If the top and bottom surfaces 17, 18 are identical to the front and back surfaces 19, 20, the bottom structural tube 1 has a square cross-section. If the top and bottom surfaces 17, 18 are not identical to the front and back surfaces 19, 20, the bottom structural tube 1 has a rectangular cross-section. The front and back surfaces 19, 20 may have nameplates and adhesive labels bearing ANSI B30.20 compliant declarations, instructions for use, safety warnings, and brand information. To reduce erosion of the nameplates and adhesive labels, ridges 9 may be manufactured into the front and back surfaces of the bottom structural tube 1.

Extending from the bottom surface 18 of the bottom structural tube 1 is a spine 15. The spine 15 is preferably manufactured as an integral element in the structural tube manufacturing process. The spine 15 extends such that it is perpendicular to the bottom surface 18 of the bottom structural tube 1. The spine 15 is aligned along the center of the bottom surface 18 and extends along a substantial length of the bottom surface 18. Most preferably, the spine 15 extends along the entire length of the bottom surface 18. A plurality of through holes 6 are distributed in the spine 15. The holes 6 are arranged in a linear pattern and are evenly spaced throughout the length of the spine 15. Most preferably, there is one center hole 7 in the spine 15 at the center vertical axis 16 of the device and the remaining holes 6 are symmetrical about this center 7.

The top structural tube 1' is preferably a rectangular-shaped elongate hollow tube having rounded edges. Preferably, the top structural tube 1' has the same cross-section as the bottom structural tube 1. Most preferably, the top structural tube 1' is identical to the bottom structural tube 1. Like the bottom structural tube 1, the top structural tube 1' has a top surface 17', bottom surface 18', front surface 19' and back surface 20', each rectangular in shape. The top structural tube 1' may have either a square or a rectangular cross-section, depending on the cross-section of the bottom structural tube 1. The front and back surfaces 19', 20' may have nameplates and adhesive labels bearing ANSI B30.20 compliant declarations, instructions for use, safety warnings, and brand information. To reduce erosion of the nameplates and adhesive labels, ridges 9 may be manufactured into the top structural tube 1'.

The top structural tube 1', like the bottom structural tube 1, has a spine 15'. However, the spine of the top structural tube 1' extends from the top surface 17' rather than from the bottom surface 18'. The spine 15' is preferably manufactured as an integral element in the structural tube manufacturing process. The spine 15' extends such that it is perpendicular to the top surface 17' of the top structural tube 1'. The spine 15' is aligned along the center of the top surface 18' and extends along a substantial length of the top surface 18'. Most preferably, the spine 15' extends along the entire length of the top surface 18'. A plurality of holes 6' are distributed in the spine 15'. The holes 6' are arranged in a linear pattern and are evenly spaced through the length of the spine 15'. Most preferably, there is one center hole 7' in the spine 15' at the center vertical axis 16 of the device and the remaining holes 6' are symmetrical about this center hole 7'.

Figure 2:
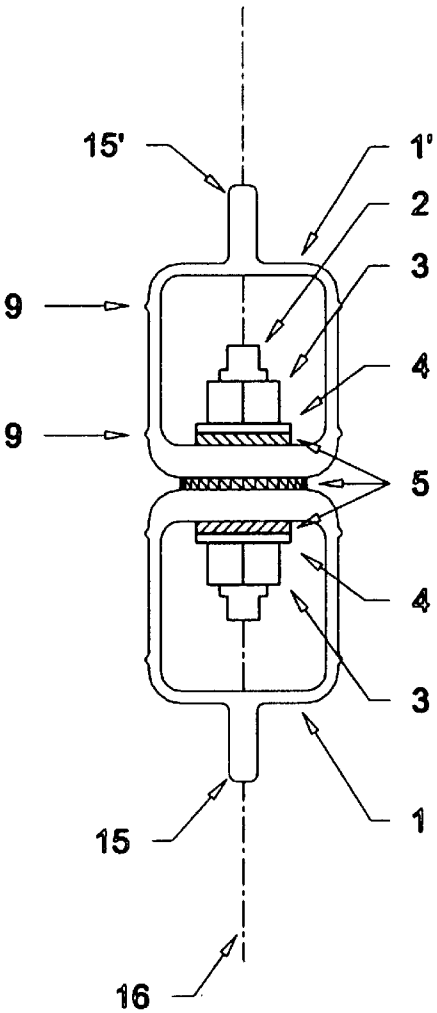
FIG. 2 is an end view of the suspension device shown in FIG. 1.

As best shown in FIG. 2, at the center vertical axis 16, an axle 2 joins the bottom structural tube 1 and the top structural tube 1'. The axle 2 is fabricated of a high strength steel and passes from the hollow portion of the bottom structural tube 1, through the top surface 17 of the bottom structural tube 1, through the bottom surface 18' of the top structural tube 1', into the hollow portion of the top structural tube 1'. The axle 2 has two threaded ends, the first extending into the hollow portion of the bottom structural tube 1 and the second extending into the hollow portion of the top structural tube 1'. A high strength locking nut 3 at each axle end holds the axle 2 in place. Between the locking nut 3 and the bottom structural tube 1 is a hardened washer 4 then a bushing 5. Between the locking nut 3 and the top structural tube 1' is a hardened washer 4 then a bushing 5. As best shown in FIG. 2, to maintain a small space between the top surface 17 of the bottom structural tube 1 and the bottom surface 18' of the top structural tube 1', a bushing 5 is situated on the axle 2 between the top surface 17 and the bottom surface 18'. The nuts 3 are tightened so as to prevent free rotation of the structural tubes with respect to each other, but to allow the bottom structural tube 1 and the top structural tube 1' to rotate in a plane with respect to each other using moderate hand pressure such that the positional relationship of one of said tubes to the other of said tubes forms a relative angle $\alpha$.

Figure 3:
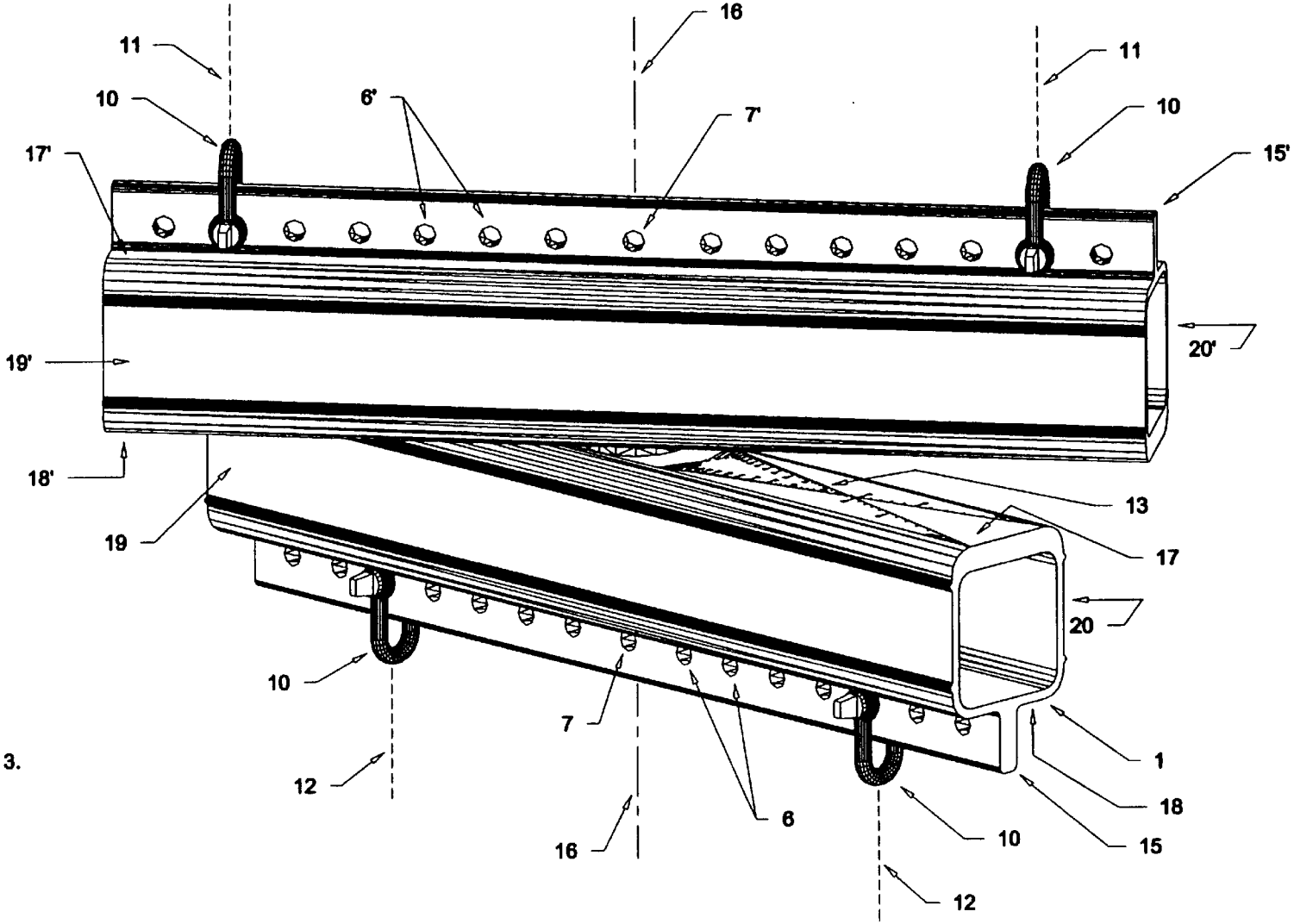
FIG. 3 is a perspective view of the suspension device shown in FIG. 1.
Figure 4:
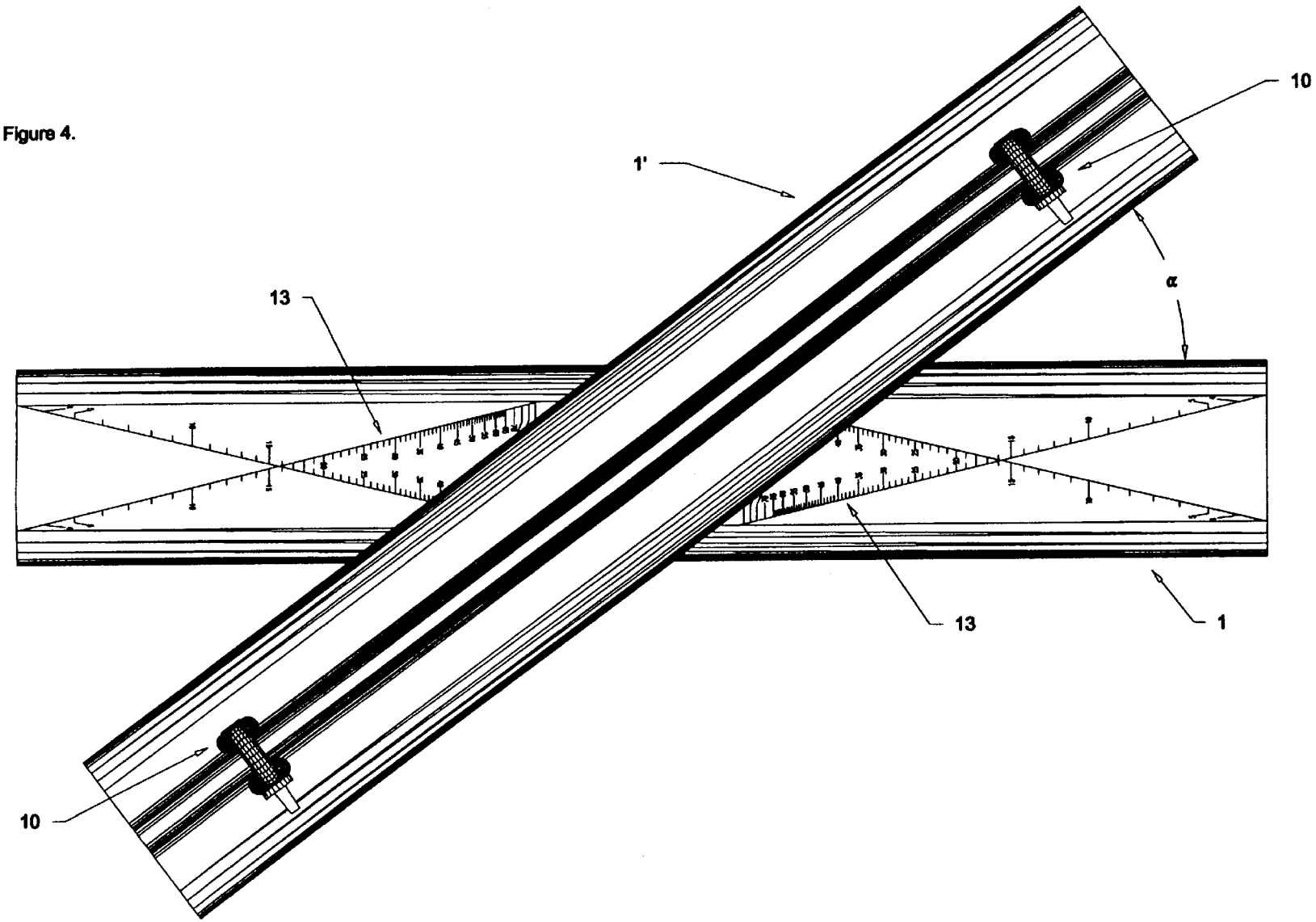
FIG. 4 is a top view of the suspension device shown in FIG. 1.

The relative angle $\alpha$ between the bottom structural tube 1 and the top structural tube 1' may be measured with vernier scales 13 built into the device, as shown in FIGS. 3 and 4. There are preferably four vernier scales 13 to allow for angle reading from four different approaches to the device: top left, top right, bottom left and bottom right. Two vernier scales 13 are on the top surface 17 of the bottom structural tube 1 as shown in FIG. 4. Similarly, two vernier scales 13 are on the bottom surface 18' of the top structural tube 1'. The vernier scales 13 are positioned at a distance near the center vertical axis 16 of the top surface 17 and the bottom surface 18'. The vernier scales 13 must be at a distance from the center vertical axis 16 such that the vernier scales 13 are exposed and may be read when the bottom structural tube 1 and the top structural tube 1' form a relative angle $\alpha$ with respect to each other.

The device is suspended with a number of industry standard anchor or chain shackles 10 that pass through the holes 6', 7' in the top structural tube 1'. Device suspension means 11, for example: wire rope assemblies, chains, or fiber straps, are then connected to the shackles 10 to suspend the device from a desired location. The device may be suspended using one shackle 10 and suspension means 11 at the center hole 7', or by using up to a maximum number of shackles 10 and suspension means 11 as there are holes 6', 7'.

A load is supported from the bottom structural tube 1 with a number of industry standard anchor or chain shackles 10 that pass through the holes 6, 7 in the bottom structural tube 1. Load supporting means 12, for example: wire rope assembles, chains, or fiber straps, are then connected to the shackles 10 to support the load from the device. The load may be supported using one shackle 10 and load supporting means 12 at the center hole 7, or by using up to a maximum number of shackles 10 and load supporting means 12 as there are holes 6, 7. Because the load supporting means are adaptable to various types of loads, an inventory of parts each adjustable to a particular type of load is not required.

While this invention has been described fully and completely with special emphasis upon certain preferred embodiments, it is to be understood that within the scope of the claims, this invention may be practiced otherwise than as specifically described.

What is claimed is:

1. A load suspension device, particularly adapted to support various types of loads while enabling said loads to be manually adjusted and focused at a desired azimuth, comprising:

two rectangular elongate structural tubes; tube A and tube B;

said structural tubes each having a center vertical axis;

said structural tubes each having a top surface, bottom surface, front surface and back surface;

said bottom surface of said structural tube B joined to said top surface of said structural tube A at said center vertical axis;

said structural tubes each having a spine extending perpendicularly from and longitudinally along said bottom surface of said structural tube A and said top surface of structural tube B;

a plurality of holes distributed in each of said spines;

shackles removably mounted on at least one of said holes; and load supporting means removably mounted on each of said shackles.

2. The device of claim 1 wherein each of said structural tubes is hollow.

3. The device of claim 1 wherein each of said structural tubes has a rectangular cross-section.

4. The device of claim 1 wherein each of said structural tubes has a square cross-section.

5. The device of claim 1 wherein each of said spines is a rectangular strip of material manufactured as an integral element of said structural tube.

6. The device of claim 1 wherein said holes are distributed along each of said spines such that said holes are all linearly and evenly spaced.

7. The device of claim 6 wherein said holes are symmetrical about said center vertical axis.

8. The device of claim 7 wherein one said hole is a center hole at said center vertical axis.

9. The device of claim 1 wherein said load supporting means is a wire rope assembly.

10. The device of claim 1 wherein said load supporting means is a chain assembly.

11. The device of claim 1 wherein said load supporting means is a fiber strap assembly.

12. The device of claim 1 wherein said structural tubes and said spines are fabricated of steel.

13. The device of claim 1 wherein said bottom surface of said structural tube B is connected to said top surface of said structural tube A by an axle.

14. The device of claim 13 wherein said axle passes through said top surface of said structural tube A and through said bottom surface of said structural tube B.

15. The device of claim 14 further comprising a bushing positioned on said axle between said top surface of said structural tube A and said bottom surface of said structural tube B.

16. The device of claim 15 wherein said axle allows said structural tube A and said structural tube B to rotate in a plane around said axle with respect to each other such that the positional relationship of one of said tubes to the other of said tubes forms a relative angle $\alpha$.

17. The device of claim 16 further comprising at least one vernier scale on the top or bottom surface of one said structural tubes positioned so as to be used to measure said relative angle $\alpha$.

18. The device of claim 17 having four vernier scales wherein two of said vernier scales are positioned on said top surface of said structural tube A symmetrical about said center vertical axis and two of said vernier scales are positioned on said bottom surface of said structural tube B symmetrical about said center vertical axis so as to be used to measure said relative angle $\alpha$.

* * * * *